United States Patent [19]

Nax

[11] Patent Number: 4,651,536

[45] Date of Patent: Mar. 24, 1987

[54] REFRIGERATED COUNTER UNIT

[75] Inventor: Heinz Nax, Frankfurt am Main, Fed. Rep. of Germany

[73] Assignee: Naz GmbH & Co., Frankfurt, Fed. Rep. of Germany

[21] Appl. No.: 570,233

[22] Filed: Aug. 19, 1983

[30] Foreign Application Priority Data

Aug. 19, 1982 [DE] Fed. Rep. of Germany ..... 3230792

[51] Int. Cl.[4] ..... A47F 3/04

[52] U.S. Cl. ..... 62/256; 62/408

[58] Field of Search ..... 62/255, 256, 247, 246, 62/408; 312/198, 253

[56] References Cited

U.S. PATENT DOCUMENTS

| | | | |
|---|---|---|---|
| 1,956,102 | 4/1934 | Long | 62/248 |
| 2,502,893 | 4/1950 | Schmidt et al. | 62/247 X |
| 2,706,387 | 4/1955 | Swanson | 62/255 X |
| 2,725,726 | 12/1955 | Swanson | 62/256 X |
| 2,810,267 | 10/1957 | Reuter et al. | 62/256 |
| 2,880,596 | 4/1959 | Brown et al. | 62/246 |
| 2,967,404 | 1/1961 | Detwiler | 62/256 |
| 3,056,274 | 10/1962 | Pouchert | 62/255 X |
| 3,293,878 | 12/1966 | Barroero | 62/255 |
| 4,019,339 | 4/1977 | Anderson | 62/255 |

FOREIGN PATENT DOCUMENTS

| | | |
|---|---|---|
| 2420632 | 11/1975 | Fed. Rep. of Germany . |
| 2922971 | 12/1980 | Fed. Rep. of Germany . |

*Primary Examiner*—William E. Wayner

*Attorney, Agent, or Firm*—Wenderoth, Lind & Ponack

[57] ABSTRACT

The invention relates to a refrigerated counter unit having a counter bed below a storage compartment, wherein a current of recirculated air is deliverd by a blower, following cooling by a heat sink and humidification, to the storage compartment, and from there back to the heat sink. The blower, the heat sink, and a humidifying unit are mounted in a housing outside the counter bed, preferably in a separate subassembly housing of the counter bed. To simplify the construction and improve efficiency, the invention provides that the cooled and humidified current of recirculated air is delivered by inlet air supply ducts to the longitudinal sections of the counter of the storage compartment air is supplied from the housing that receives the blower, the heat sink, and the humidifying unit by means of a plurality of air supply ducts that are separated from one another and extend throughout at least a fraction of the length of the counter bed.

28 Claims, 4 Drawing Figures

REFRIGERATED COUNTER UNIT

BACKGROUND OF THE INVENTION

The invention relates to a refrigerated counter unit having a counter bed which is below a storage compartment, wherein a current of recirculated air delivered by a blower, following cooling by a heat sink, e.g., an evaporator, and humidification, is delivered to the storage compartment and from there back to the heat sink, wherein a blower, the heat sink, and a humidifying unit are mounted in a housing outside the counter bed, preferably in a separate subassembly housing of the counter bed.

Such a refrigerated counter unit is, for example, disclosed in West German Unexamined Application No. 24 20 632.

This prior art counter is either relatively short, so that one can manage with one blower without jeopardizing the steadiness of the air flow along the length of the counter, or the counter is relatively long in which case a plurality of blowers are placed side by side along the length of the counter. The heat sink, designed as an evaporator, extends in either case along the whole length of the counter, so that a uniformly cooled current of recirculated air rises along the length of the counter. In the same way, the water tub mounted there for the humidification of the current of refrigerated air shall also extend along the entire length of the counter. Accordingly, the constructional complexity is unduly great. In many cooling counters of the prior art, blower, heat sink and, if necessary, humidification unit are mounted within the counter bed proper. The considerable structural complexity and the need for special cover bottoms causes problems in the cleaning of the counter interior because of the elaborate construction of the cover bottoms.

SUMMARY OF THE INVENTION

Therefore, the primary object of the invention is to simplify the construction of the refrigerated counter unit of the kind described in the background, to provide easier cleaning of the counter compartment, and to improve its efficiency.

The foregoing object is accomplished by the present invention by delivering the cooled and humidified current of recirculated air from the compartment of the housing that receives the blower, the heat sink, and the humidifying unit by means of a plurality of air-supply ducts which are separated from one another and extend along at least a fraction of the length of the counter bed to the longitudinal sections of the storage compartment assigned to the housing.

As a result of the duct system provided by the invention, blower, heat sink, and humidifying unit can be accommodated in a separate housing, e.g., also in a separate space, but preferably in a subassembly housing of the counter bed. However, it is no longer necessary, as in the past, to provide (in the case of relatively long counters) several blowers which are distributed along the length of the counter and to spread the heat sink and the humidifying unit along the entire length of the counter. According to the teachings of the invention, the pressurized, cooled, and humidified air is only prepared in the separate housing and uniformly distributed by means of the duct system along the longitudinal sections of the merchandise storage compartment that makes up the entire length of counter.

The housing featuring the blower, the heat sink and the humidifying unit forms, so to speak, a central unit which looks after the supply of the whole counter with cold, humidified recirculated air.

Therefore, for the special case where the housing is designed as a subassembly housing of the counter bed, it need only have a fraction of the length of the counter bed. The remaining space underneath the counter bed which, in the case of the aforementioned prior art refrigerated counter, is completely filled, remains free for other purposes.

A surprising fact found by the inventor was that as a result of this compact design of the central unit for the supply of the cold, humidified recirculated air, which is distributed via a duct system along the length of the counter, the energy efficiency is greater than in cooling counters of the prior art. Another surprising fact was that despite the relatively long conveyance paths of the cooled, humidified recirculated air from the central unit to the individual sections of the storage compartment, the quality of the recirculated air with respect to temperature and/or moisture content is not adversely affected. This is particularly true if, as proposed by the invention, the air is humidified by means of an overheated vapor supplied by an internal vapor generator (e.g., an electrically heated vapor generator), and injected into the current of recirculated air through a nozzle tube. The internal vapor generator works with fresh water, so that contamination of the counter compartment, odor formation, lime deposits, etc. can be avoided.

Preferably, the blower is mounted on the buyer side, and the humidifying unit on the seller side of the heat sink in the compartment of the subassembly housing. In this way, the current of recirculated air flows in the area of the subassembly housing from the blower through the heat sink, past the humidifying unit, in the direction from the buyer side to the seller side of the refrigerated counter unit. Thus, the humidified cold air is available on the seller side in the compartment of the subassembly housing, which promotes short conveyance paths to the seller side of the counter compartment.

In the present invention, inlet air supply ducts open through outlet orifices or through a common outlet slot on the seller side into the storage compartment. Therefore, in the storage compartment the current of recirculated air is directed from the seller side to the buyer side, resulting in the great advantage that the surfaces of the merchandise turned toward the buyer side are not blown against by the recirculated air, so that the merchandise does not become rapidly unattractive. This is of particular importance in the case of sausages, cheese, etc. that have already been cut.

If the heat sink and the blower are mounted as a compact modular unit in the subassembly housing provided with a buyer-side and a seller-side closable assembly opening, the compartment of the housing is easily accessible for maintenance and installation of blower, heat sink, and humidifying unit. If necessary, the modular unit composed of heat sink and blower can be taken out of the housing as a whole. However, it is also possible, for example, to design this modular unit, including humidifying unit and housing, as a prefabricated exchange plug-in cabinet element so that it can quickly be substituted for a defective element and stored for various counters.

In this connection, it should be pointed out that the heat sink need not be a conventional evaporator. By way of example, a liquid nitrogen container may also serve as a heat sink, from which the required volume of nitrogen is delivered to the current of recirculated air. This mode of cooling the current of recirculated air is not limited to the present counter design.

Advantageously, the humidifying unit may consist of a nozzle tube which at the most extends along the length of the housing and can be supplied with vapor. Thus, unlike conventional counters, the nozzle tube need not extend along the entire length of the counter bed, as already mentioned above.

In another embodiment of the inventive concept, a deflector plate is provided between heat sink and humidifying unit which guides the current of recirculated air past the humidifying unit. In this way, the stream of recirculated air does not strike directly upon the nozzle tube in a disadvantageous manner, but carries the vapor issuing from the nozzle tube away only because of then negative pressure. It has been shown that in this way one can achieve very fast and intensive uniform vapor humidification of the air-supply current, which is important in this case, because the "preconditioned" cold air shall already be available upon exiting from the compartment of the separate housing.

In a preferred embodiment of the inventive concept, the air supply duct system provided according to the teachings of the invention is characterized in that each of the air supply ducts has a substantially horizontal air-supply duct section. The air-supply ducts are all substantially parallel to one another and are in fluid communication with the section of the subassembly housing compartment fitted downstream of the blower, heat sink and the humidifying unit. The air-supply ducts are joined to substantially vertical air-supply ducts in the area of the respective outlet orifice or of the outlet slot. The vertical air-supply ducts are substantially parallel to one another.

A very simply constructional design is achieved by defining the supply ducts by plates extending over a substantial portion of their length in the longitudinal direction of the counter.

If the subassembly housing (viewed along the length of the counter bed) is mounted substantially in the area of the counter bed center and the horizontal sections of the air-supply ducts branching off from the compartment of the subassembly housing in both longitudinal directions are divided by a separator plate extending in the transverse direction of the counter, a uniform supply of the humidified cold air can be ensured along the entire length of the storage compartment despite any eccentricity of the arrangement of the subassembly housing that may be necessary. The separator plate divides each pair of air supply ducts which extend in both longitudinal directions of the counter according to the volume of air required for the length of the assigned counter section.

In another embodiment of the invention, the vertical air-supply ducts reach upwardly as far as the seller-side counter. This means that the outlet orifices or outlet slot can lie directly under the counter. In this way, the humidified cold air passing therethrough travels from the rear to the merchandise to be cooled in storage compartment without considerable energy losses. This guidance of the cold air current has proved to be very favorable and economical.

In another embodiment of the inventive concept, there are provided in the area of the outlet orifices or of the outlet slot of the inlet air conduits, which extends throughout the length of the counter bed, substantially parallel plates that are spaced a distance one above the other and run in the longitudinal direction of the counter in order to bring about an even better distribution of the humidified cold air current.

Preferably, the return air current is discharged from the storage compartment through a return-air inlet slot shared by all the longitudinal sections of the counter. The return-air inlet slot extends in the longitudinal direction of the counter and is preferably provided in the bottom of the seller-side area of the counter bed, preferably into a seller-side section of the compartment of the subassembly housing. The return air current is discharged downwardly through a discharge slot which is kept clear at the buyer side of the counter. The discharge slot extends throughout the length of the counter bed to return air underneath the merchandise support plate to the return-air inlet slot whereby additional cooling of the merchandise support plate is provided.

A substantially horizontal return-air duct section may be attached to the return-air inlet slot which extends throughout the length of the counter bed, so that a uniform sucking of the return air throughout the counter length is assured. This uniform horizontal sucking can also have repercussions on the uniform supply of the humidified cold air through the outlet slot.

A particularly simple form of construction results if the return air inlet slot extending throughout the length of the counter bed is formed as an intervening space between a plate and the counter bed bottom.

The plates forming the horizontal air supply ducts and to return-air duct section may, for example, be connected together to form a swing-out unit to enable a simple, all-around cleaning of these plates.

It is also a part of the inventive concept that the air-supply ducts can have different cross-sectional areas in conformity with the longitudinal sections of the counter to be supplied by them. By taking into account the different lengths of the air-supply ducts and the different pressure drops resulting therefrom, it is possible to provide matching cross-sectional areas corresponding to the proper equalization, so that the downstream volume of the humidified cold air from the outlet orifices or from the outlet slot is substantially equal throughout the length of the counter. Thus, for example, the shorter air-supply ducts can have a smaller cross section that the longer ones. However, through special selection of the cross-sectional area, one can also ensure that in specially selected longitudinal sections of the counter, e.g., in view of special merchandise stored there, another temperature and/or humidity is provided than in the remaining area of the counter section. Consequently, zones with different cooling and/or humidification can be created deliberately.

Further objects, features, advantages and application possibilities of the present invention will become apparent from the following description of a practical embodiment with the aid of the accompanying drawings, whereby all the features described and/or represented symbolically in any meaningful combinations constitute the subject matter of the present invention.

DETAILED DESCRIPTION

Figure 1:
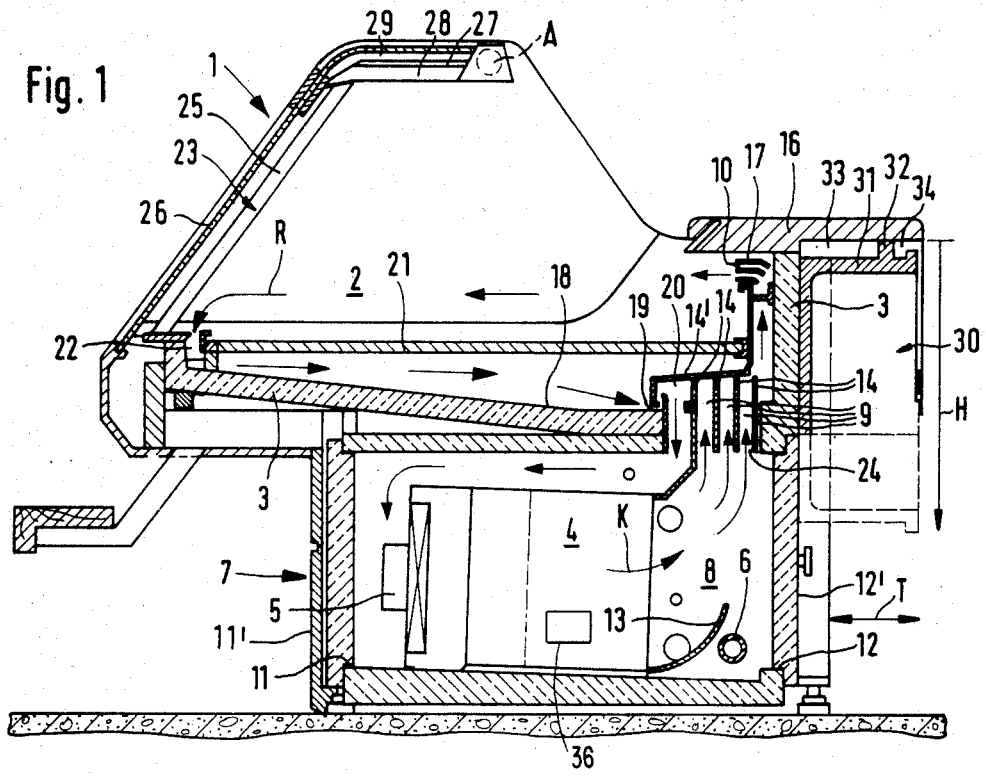
FIG. 1 shows schematically a section view of a counter unit featuring the invention taken along the line I—I of FIG. 3 in the area of the subassembly housing.

The cooling counter unit or units 1 shown in FIGS. 1 through 4 have a storage compartment 2 above a counter bed 3. Projecting over the storage compartment on the buyer side is a counter display case 23 having swing-out front plates 26, made of safety glass. The counter display case has consoles 25 that face the buyer side and on which a front plate 26 is hinged via a bearing arm 29. Articulated shaft A is disposed at the rear end of a horizontally extending console section 28 which projects over the storage compartment. Front plate 26 is curved at its upper edge to form a horizontal merchandise tray.

Figure 3:
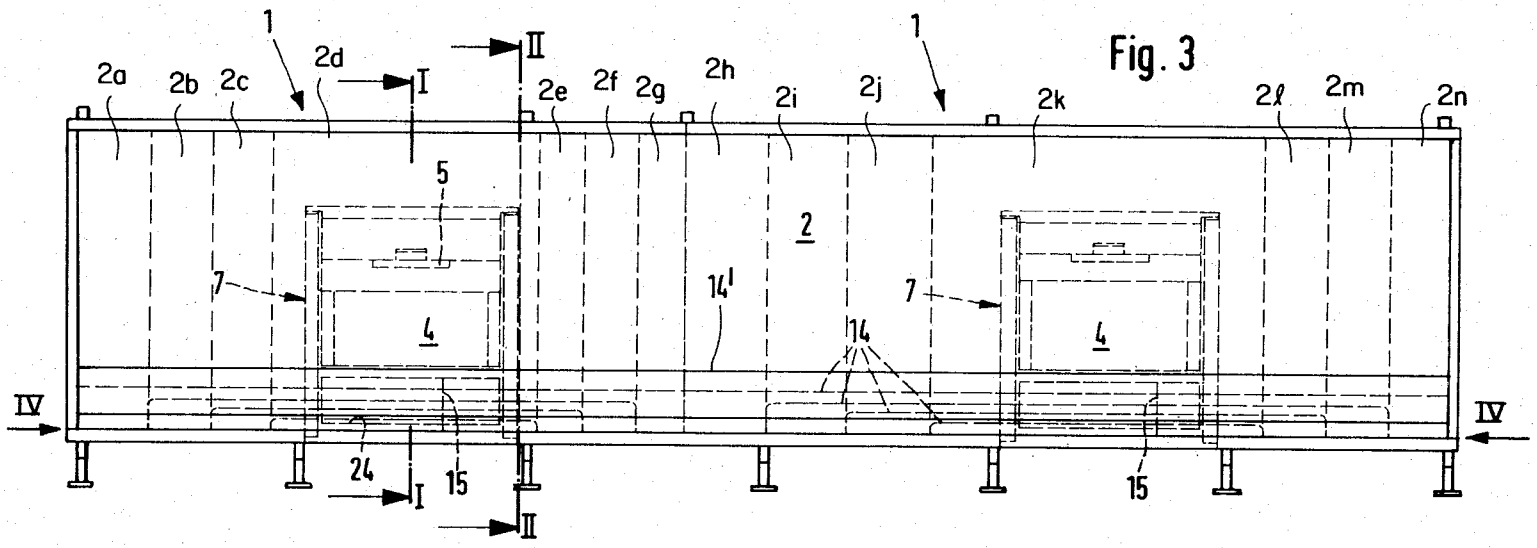
FIG. 3 is a top view of two cooling counter units arranged side by side and embodying the invention.
Figure 4:
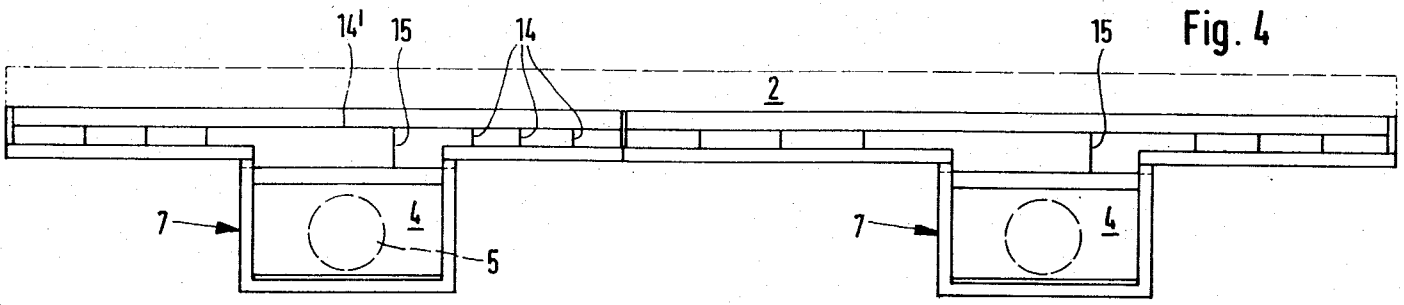
FIG. 4 is a view from direction IV—IV of the two cooling counter units of FIG. 3.

Beneath counter bed 3 there is provided a housing 7 which, as apparent from FIGS. 3 and 4, has a second length less than a first length of counter bed 3. In the separate housing 7, which is constructed as a subassembly housing for counter bed 3, there are housed a blower 5, a cold source 4, and a humidifying unit 6 in the shape of a nozzle tube. This nozzle tube 6 is connected to an internal vapor generator in a manner not shown. Blower 5 is disposed on the seller side of compartment 8 of housing 7 to which cold source 4 is attached in a modular unit in the direction of the seller side. In the section between the outlet orifice of cold source 4 which, for example, is constructed as an evaporator, and the upper air-passage 24 to the storage compartment 2 there is disposed a humidifying unit 6, in this particular case in the lower right-hand corner of this compartment section. A reflector plate 13 ensures that the cold air current K does not impact directly on humidifying unit 6, such that the vapor escaping from humidifying unit 6 is carried away by cold air current K only above deflector plate 13. The heat sink and humidfying unit may be controlled by manual adjustment of actuators located in a control console 36.

Housing 7 has on the buyer side an assembly opening 11, and on the seller side an assembly opening 12, which can both be closed hermetically by a cover 11', 12'. In the upper wall housing 7, the aforementioned air passage 24 is left open in the area of the seller side. In this opening emerge air-supply ducts 9 which are defined by vertical plates 14 and which in the counter area laterally of subassembly housing 8 take on the shape depicted in FIG. 2. As apparent from FIG. 3, each air-supply duct has a horizontal section on both sides of housing 7 which leads to a predetermined longitudinal section (*2a*, *2b*–or *2n*, as shown in FIG. 3) of the counter. Each air-supply duct 9 passes into a vertical duct section which opens into a separate outlet orifice 10 or into a continuous outlet slot. Vertical plates 14 are covered on top by a horizontal or slightly inclined plate 14' which is connected thereto to form a swing-out unit (cf. FIG. 2). At the bottom, plates 14 have bent lower portions which rest on bottom 18 of the counter bed, so that air-supply ducts 9 in the area laterally of air passage 24 are closed all around, while in the area of air passage 24 they are open, at least at the bottom, for receiving the humidified cold air K. This duct system results in a substantially uniform distribution of the humidified cold air K throughout the length of counter bed 3 and, thereby, of merchandise-storage room 2.

If housing 7, as apparent from the practical example depicted in FIGS. 3 and 4, viewed in the direction of the counter, is not centered, the half of the cooling counter unit illustrated on the right-hand side of the drawing would receive a larger volume of cold air than the half of the cooling counter unit depicted on the left-hand side of the drawing. To prevent this, the two horizontal air supply ducts extending in the opposite longitudinal directions of the counter are divided asymmetrically, in conformity with the eccentricity of housing 7, by a separator plate 15 which extends in the transverse direction of the counter, so that an even distribution of the cold air current throughout the length of the counter can be achieved. However, separator plate 15 can also be deliberately positioned otherwise, so that specified longitudinal sections of the counter receive a larger volume of cold air than other sections. As particularly apparent from FIGS. 1 and 2, the cross-sectional area of the inlet air conduit sections diminish toward the seller side. As can be seen in FIG. 3, this results from the fact that outermost seller-side air-supply duct 9 has the shortest, and outermost buyer-side air-supply duct 9 is the longest in length. The cross-sectional area of each air-supply duct 9 is dimensioned in such a way that the air flow resistance for all air supply ducts is substantially the same if a uniform cold air distribution is to be achieved throughout the length of the counter.

Figure 2:
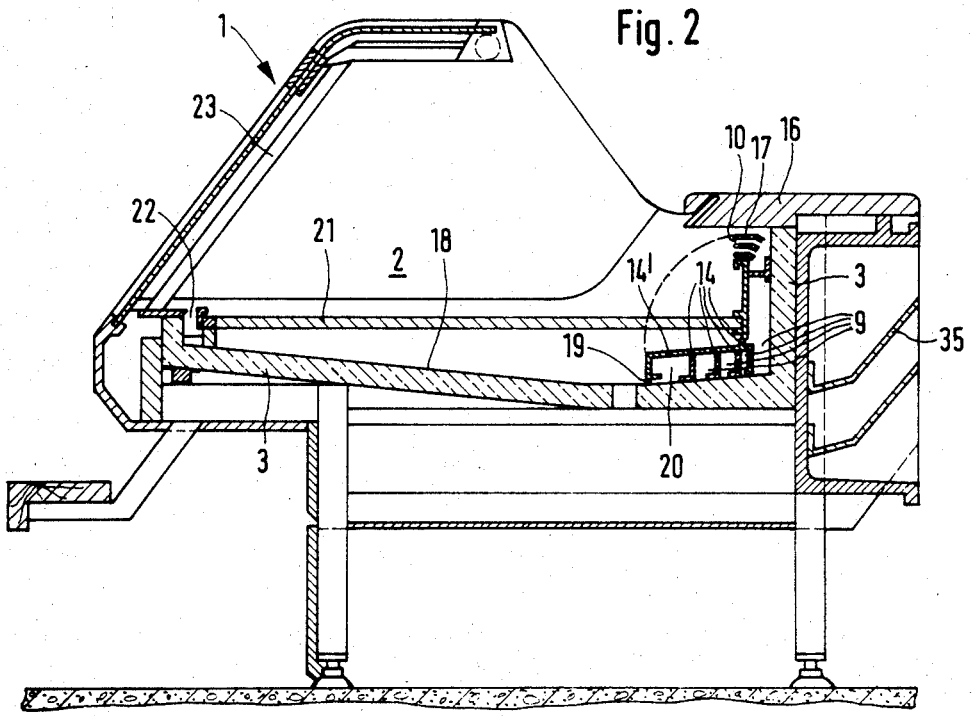
FIG. 2 is a section view according to FIG. 2 and taken along the line II—II of FIG. 3 through a cooling counter unit outside the subassembly housing featuring the invention.

From FIGS. 1 and 2 it is apparent that air-dupply ducts 9 open into a seller-side vertical air-supply duct sections which reach up to a position beneath a seller-side counter top 16. Directly underneath this counter 16 and on the side turned toward storage compartment 2, air supply ducts 9 open into outlet orifices 10 or into a common continuous outlet slot. These orifices 10 or the slot are divided by horizontal plates 17 which extend in the longitudinal direction of the counter and are spaced a distance one above the other for further even distribution of the cold air current.

In merchandise storage compartment 2, the cold air flows from inlet orifices 10 to the merchandise exhibited there, namely in the direction of the arrow illustrated in the FIG. 1. On the buyer side, the return air current R is discharged via a discharge slot 22, kept clear on the upper edge of a merchandise support plate 21 and extending throughout the length of merchandise storage compartment 2 to a return air inlet slot 19 provided in the seller-side area. In this way, the still-cold return air is run along the merchandise underneath merchandise support plate 21 for further cooling. Return-air inlet slot 19 is kept clear between a bent lower portion of plate 14' and the bottom of counter bed 3. A substantially horizontal return-air duct section 20 extending throughout the length of the counter bed is attached thereto, so that the return air is sucked uniformly into the section of compartment 8 of housing 7 which is partitioned off above heat sink 4, thus separating the current of recirculated air from the air supplied to the storage compartment.

To form the rear front of the counter, there are attached to counter bed 3, in a free space underneath counter 16 of counter bed 3, prefabricated plug-in cabinet elements 30. Cabinet elements 30, which are adapted to the various usage functions but are standardized in conformity with their outside dimensions, are keyed to each other in width with respect to a modular dimension, and have a one-piece base plate 31 made from plastic which is open toward the rear. Preferably, the plug-in cabinet elements have the same height h and and the same depth t. Each plug-in cabinet element 30 consists of a box-shaped base plate 31 from polyurethane and has outlwardly-turned cover flanges 32 which determine the outside dimensions. Base plate 31 and cover flange 32 are made of one piece. At least one cable strip 33 is kept clear at the top of base plate 31 behind cover flange 32. In front of cover flange 32 there is also provided an externally accessible cable duct 34 starting from the rear front. As shown in FIG. 2, paper or bag support shelves 35, sloping obliquely into the interior of counter bed 3, are mounted in base plate 31.

LIST OF REFERENCE NUMERALS

1: refrigerated counter unit
2: storage compartment
3: counter bed
4: heat sink
5: lower
6: humidifying unit
7: housing
8: compartment
9: air-supply ducts
10: outlet orifices or continuous slot
11: assembly orifice opening
11': cover
12: opening
12': cover
13: deflector plate
14: plate
14': plate
15: separator plate
16: counter top
17: plate
18: bottom
19: return air inlet sot
20: return-air duct section
21: merchandise support-plate
22: discharge slot
23: counter display case
24: air passage opening
25: consoles
26: front plate
27: merchandise tray
28: console section
29: bearing arm
30: plug-in cabinet element
31: base plate
32: cover flange
33: cable duct
34: cable duct
35: paper or bag storage shelf.

I claim:

1. A refrigerated counter unit comprising:

a counter bed extending a first length in a longitudinal direction;

a storage compartment located above said counter bed;

a plurality of sections in said storage compartment spaced along said longitudinal direction;

at least one housing located outside said counter bed;

a heat sink and a blower mounted in said housing for supplying cooled air to said storage compartment;

said housing extending in said longitudinal direction a second length which is less than said first length;

an air passage extending through said housing for supplying cooled air to said storage compartment;

a plurality of air-supply ducts in fluid communication with said air passage, each of said air-supply ducts extending in said longitudinal direction to only one of said plurality of sections in said storage compartment;

a return-air duct extending in said longitudinal direction and being in fluid communication with each of said plurality of sections in said storage compartment, said return-air duct further being in fluid communication with said housing for supplying air from said storage compartment back to said housing; and a return-air inlet slot provided in said return air-duct along said longitudinal direction of said counter unit, said return air inlet slot being in fluid communication with each of said plurality of longitudinal sections of said storage compartment and further being in fluid communication with said return-air duct;

whereby cooled air is recirculated to said storage compartment by being fed from said housing through said air passage and into each of said air-supply ducts, after which air is delivered from said air-supply ducts to said individual sections of said storage compartment followed by return of the air in the storage compartment through said return-air duct to said housing.

2. The refrigerated counter unit of claim 1, wherein said ducts and said return air-duct are formed of vertical plates.

3. The refrigerated counter unit of claim 2 wherein said vertical plates form said plurality of air-supply ducts which are separated from one another, each of said air-supply ducts extending over only a fraction of said first length of said counter bed for supplying cooled air to an individual section of said storage compartment.

4. The refrigerated counter unit of claim 3 further comprising outlets or a continuous outlet slot located along the longitudinal direction of said counter bed, said outlets or continuous outlet slot being in fluid communication with said storage compartment and said plurality of air-supply ducts.

5. The refrigerated counter unit of claim 4 wherein plates are provided in the area of said outlets or said continuous outlet slot, said plates being spaced apart and extending parallel to each other in the longitudinal direction of said counter unit, whereby an even distribution of air is supplied to the longitudinal sections of said storage compartment.

6. The refrigerated counter unit of claim 2 wherein said plates forming said plurality of air-supply ducts and said return air duct are connected together to form a swing-out unit, whereby said plates can be easily cleaned.

7. The refrigerated counter unit of claim 1 wherein a bottom portion of said plurality of air-supply ducts is in fluid communication with said air passage and said plurality of air-supply ducts are covered on the top thereof by a plate.

8. The refrigerated counter unit of claim 1 wherein said blower is placed on a side of an interior of said housing which faces a buyer-side of said counter unit and further comprising a humidification unit which is placed on a side of said interior of said housing which faces a seller-side of said counter unit, said heat sink being placed between said blower and said humidification unit.

9. The refrigerated counter unit of claim 8 wherein said humidification unit comprises a nozzle tube which is supplied with vapor, said nozzle tube extending only along the length of said housing.

10. The refrigerated counter unit of claim 8 wherein a deflector plate is provided between said heat sink and said humidification unit to prevent cooled air from directly contacting said humidification unit.

11. The refrigerated counter unit of claim 1 wherein said blower and said heat sink are removably mounted as a compact modular unit in said housing, said housing being provided with an access opening on a seller-side of said housing and an access opening on a buyer-side of said housing, said access openings being closed with covers to allow quick access to the interior of said housing for maintenance and installation of said blower and said heat sink.

12. The refrigerated counter unit of claim 1 wherein each of said plurality of air-supply ducts are connected to an outlet or a continuous outlet slot which is located along the longitudinal direction of said counter bed, said outlets or continuous outlet slot being in fluid communication with said storage compartment, said air-supply ducts being substantially parallel to each other and said air-supply ducts being connected to said outlets or said continuous outlet slot by means of vertical air-supply duct sections.

13. The refrigerated counter unit of claim 12 further comprising a counter top which is located on a seller-side of said counter unit, said vertical air-supply duct sections extending upwardly above said counter bed to a position beneath said counter top.

14. The refrigerated counter unit of claim 1 wherein said housing is mounted under the counter bed at a position near the center of the length of said counter unit, each of said plurality of air-supply ducts having portions extending in both longitudinal directions away from the center of said counter.

15. The refrigerated counter unit of claim 1 further comprising, a merchandise-support plate which is provided above said counter bed, said support plate extending in said longitudinal direction of said counter bed;

a discharge slot being provided on a buyer-side of said counter unit, said discharge slot being formed between said merchandise-support plate and the buyer-side of said counter bed;

said discharge slot being in fluid communication with said storage compartment and said return-air inlet slot;

whereby air is returned to said housing from the buyer-side of said storage compartment.

16. The refrigerated counter unit of claim 1 wherein said return air duct includes a plate which extends in the longitudinal direction of said counter bed, said return-air inlet slot is formed as a space between said plate of said return air duct and said counter bed.

17. The refrigerated counter unit of claim 1 wherein said plurality of air-supply ducts have different cross-sectional areas for causing a desired volume of air to flow to a respective individual section of said storage compartments.

18. The refrigerated counter unit of claim 1 wherein a counter display case is mounted above said counter bed, said counter display case having consoles located on a buyer side of said counter unit, each of said consoles having a face plate which is rotatable about a horizontal axis, said axis being located on the top of said display case.

19. The refrigerated counter unit of claim 18 wherein said face plate is curved from a buyer-side toward a seller side of said cooling unit to provide a horizontal merchandise tray above said storage compartment.

20. The refrigerated counter unit of claim 18 wherein said face plate consists of safety glass.

21. The refrigerated counter unit of claim 18 wherein an upper end of said consoles projects into a horizontal console section which is located above said storage compartment and said front plate is hinged to the rear of said horizontal console section by means of a bearing arm.

22. The refrigerated counter unit of claim 1 further comprising a control console having manual actuators is connected to said heat sink and blower for controlling the cooling of said counter unit.

23. The refrigerated counter unit of claim 1 further comprising a counter top which extends from a seller-side of said counter unit; at least one plug-in cabinet made of one-piece plastic removably positioned below said counter top, said cabinet having an opening of one side thereof located below said counter top and facing away from said counter unit, whereby a plurality of uniformly shaped, removable cabinets can be mounted along the longitudinal direction of said counter unit below said counter top.

24. The refrigerated cooling unit of claim 23 wherein said plug-in cabinets have the same dimensions.

25. The refrigerated counter unit of claim 23 wherein said plug-in cabinet has a cable duct which is formed by a space between said counter top and a top of a base plate of said cabinet, said space being located on either side of a flange extending on top of said plate in the longitudinal direction of said counter unit.

26. The refrigerated counter unit of claim 23 wherein an externally accessible cable duct is provided between the top of a base plate forming said one-piece plug-in cabinet and the bottom of said counter top.

27. The refrigerated counter unit of claim 25 wherein said base plate and said flange are formed in one piece from plastic.

28. The refrigerated counter unit of claim 23 wherein a base plate of said plug-in cabinet is provided with shelves, said shelves being sloped obliquely towards said counter bed for holding paper or bags.

* * * * *